US009322230B2

(12) United States Patent
Talamo et al.

(10) Patent No.: US 9,322,230 B2
(45) Date of Patent: Apr. 26, 2016

(54) DIRECT DRIVE FLUID PUMP FOR SUBSEA MUDLIFT PUMP DRILLING SYSTEMS

(75) Inventors: Emil R. Talamo, San Antonio, TX (US); John H. Cohen, Houston, TX (US)

(73) Assignee: AGR SUBSEA, AS, Straume (NO)

( * ) Notice: Subject to any disclaimer, the term of this patent is extended or adjusted under 35 U.S.C. 154(b) by 0 days.

(21) Appl. No.: 14/122,179

(22) PCT Filed: May 9, 2012

(86) PCT No.: PCT/US2012/036993

§ 371 (c)(1),
(2), (4) Date: Dec. 26, 2013

(87) PCT Pub. No.: WO2012/177331

PCT Pub. Date: Dec. 27, 2012

(65) Prior Publication Data

US 2014/0102805 A1 Apr. 17, 2014

Related U.S. Application Data

(60) Provisional application No. 61/499,531, filed on Jun. 21, 2011.

(51) Int. Cl.

| | |
|---|---|
| ***F04B 49/00*** | (2006.01) |
| ***E21B 7/128*** | (2006.01) |
| ***E21B 21/00*** | (2006.01) |

(52) U.S. Cl.

CPC ..... *E21B 21/001* (2013.01)

(58) Field of Classification Search

None

See application file for complete search history.

(56) References Cited

U.S. PATENT DOCUMENTS

| | | | | |
|---|---|---|---|---|
| 3,477,523 | A | 11/1969 | Lewis | |
| 4,145,165 | A | 3/1979 | Perkins et al. | |
| 4,276,003 | A * | 6/1981 | Perkins | E21B 21/01 184/24 |
| 4,276,033 | A * | 6/1981 | Krovina | B63H 9/0685 114/102.17 |
| 5,333,691 | A | 8/1994 | Dean et al. | |
| 6,325,159 | B1 * | 12/2001 | Peterman | E21B 21/001 166/350 |
| 6,505,691 | B2 | 1/2003 | Judge | |
| 7,677,329 | B2 * | 3/2010 | Stave | E21B 21/001 166/358 |
| 8,029,247 | B2 * | 10/2011 | Cedrone et al. | 417/274 |
| RE43,199 | E * | 2/2012 | Fossli | E21B 21/001 166/364 |
| 2005/0158191 | A1 | 7/2005 | Autrey | |
| 2010/0252269 | A1 | 10/2010 | Legrand | |

FOREIGN PATENT DOCUMENTS

| | | | |
|---|---|---|---|
| GB | 2210419 | A1 | 6/1989 |
| WO | 2008110187 | A1 | 9/2008 |

OTHER PUBLICATIONS

Notification Concerning Transmittal of International Preliminary Report on Patentability of PCT/US2012/036993, Jan. 9, 2014.

Notification of transmittal of the international search report and the written opinion of the international searching authority, or the declaration, PCT/US2012/036993, Oct. 8, 2012.

* cited by examiner

*Primary Examiner* — Matthew R Buck
*Assistant Examiner* — Douglas S Wood
(74) *Attorney, Agent, or Firm* — Richard A. Fagin; Adenike Adebiyi

(57) ABSTRACT

A subsea mudlift pump includes a pressure sealed housing disposed in a body of water in which a wellbore is being drilled by a drilling rig disposed above the surface of the body of water. A motor (44) is configured to generate linear motion is coupled to at least one piston (46) disposed within the housing such that operation of the mo¬ tor causes linear motion of the piston within the housing. One side of the piston is within a pumped fluid chamber that changes volume when the piston is moved within the housing.

5 Claims, 4 Drawing Sheets

DIRECT DRIVE FLUID PUMP FOR SUBSEA MUDLIFT PUMP DRILLING SYSTEMS

CROSS-REFERENCE TO RELATED APPLICATIONS

Background

The disclosure relates generally to the field of subsea wellbore drilling using a pump in a drilling fluid return line ("subsea mudlift pump") to maintain a selected pressure in the wellbore that is different than the pressure that would exist based on the wellbore depth and specific gravity of the drilling fluid. More specifically, the disclosure relates to subsea mudlift pumps that do not use hydraulic pressure as the driving force to operate the pump.

Subsea mudlift pumps are used in wellbore drilling in selected water depths to enable maintaining a fluid pressure and pressure gradient in the wellbore that is different than would be the case with conventional drilling, wherein drilling fluid pumps located on a drilling unit above the water surface pump drilling fluid into the well at such rates and pressures as to enable lifting the drilling fluid all the way from the bottom of the wellbore and back to the drilling unit above the water surface. As is known in the art, the fluid pressure in the wellbore and pressure gradient are related to the pressure of the drilling fluid being pumped at the surface, the depth of the wellbore, the specific gravity ("mud weight") of the drilling fluid and the frictional pressure losses in the wellbore. It is known in the art to use a pump in the drilling fluid return line to the drilling unit above the water surface to lower the pressure and pressure gradient in the wellbore annulus (the space between the drill string and the wall of the wellbore) so that drilling may proceed to greater depths without the need to set a protective liner or casing in the wellbore. Such "subsea mudlift pump drilling" techniques enable having a larger diameter wellbore at the planned total wellbore depth because fewer concentrically placed protective casings or liners may be needed than when using conventional drilling techniques. One example of such technique is described in U.S. Pat. No. 7,677,329 issued to Stave and incorporated herein by reference. One limitation to subsea mudlift pump systems known in the art is that the pump in the drilling fluid return line may be operated by hydraulic pressure. While effective, such hydraulically operated pumps may require complex hydraulic operating fluid control systems in order to have the pump output be substantially pulsation free. Other systems may use centrifugal or disk type pumps, which may not be able to maintain precise control over the volume of fluid pumped to the surface, making pressure control a more complex task than with positive displacement pumps such as the hydraulically operated pumps described above.

What is needed is a positive displacement subsea mudlift pump and/or pump system for use in subsea mudlift drilling that does not require hydraulic fluid to provide power to the pump or pump system.

SUMMARY

A subsea mudlift pump according to one aspect includes a pressure sealed housing disposed in a body of water in which a wellbore is being drilled by a drilling rig disposed above the surface of the body of water. At least one of a stepper motor and a servo motor is coupled to at least one piston disposed within the housing such that operation of the motor causes linear motion of the piston within the housing. One side of the piston comprises a pumped fluid chamber that changes volume when the piston is moved within the housing.

Other aspects and advantages will be apparent from the description and claims which follow.

DETAILED DESCRIPTION

Figure 1:
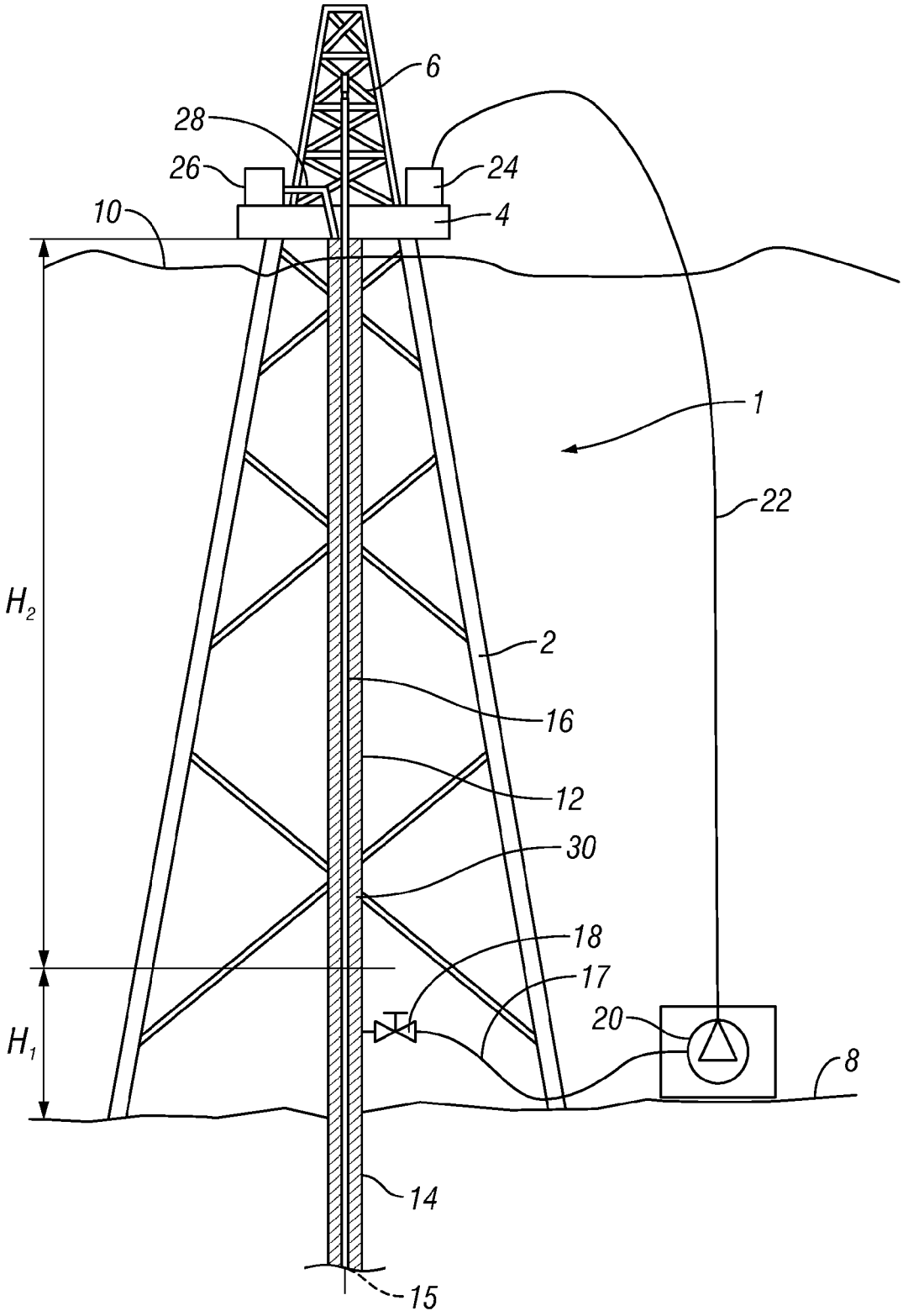
FIG. 1 shows an example of a subsea mudlift drilling system with a subsea mudlift pump proximate the bottom of a body of water in which a wellbore is being drilled.

Referring to FIG. 1, when a wellbore is drilled from a fixed platform or floating drilling platform ("drilling rig") 1 disposed above the surface of a body of water, a conductor is first driven into the water bottom or seabed. When drilling a wellbore 15 from a drilling rig 1, drilling fluid may be pumped using a mud pump 26, through an interior conduit in a drill string 16 suspended by a kelly or top drive, down to a drilling tool, which may terminate in a drill bit (not shown) that cuts through the sub-bottom formations to lengthen the wellbore 15. The drilling fluid serves several purposes, some of which are to transport drill cuttings out of the borehole, and to maintain fluid pressure in the wellbore 15 to prevent collapse of the wellbore 15 and prevent entry of fluids into the wellbore 15 from exposed formations. Efficient transport of drill cuttings requires that the drilling fluid is relatively viscous. The drilling fluid flows back through an annulus 30 between the wellbore wall, a liner or casing 14 and the drill string 16, and up to the drilling rig 1, where the drilling fluid may be treated in devices 24 for such purposes and conditioned before being pumped back down into the wellbore 15. In some cases, the combined pressure of pumping and the selected density of the drilling fluid will result in a head of pressure and/or pressure gradient in the wellbore annulus 30 that is undesirable.

By coupling a subsea mudlift pump 20 to the liner 14 near the seabed (or to the wellhead when drilling, e.g., from a floating drilling platform), the returning drilling fluid can be pumped out of the annulus 30 and up to the drilling rig 1 to reduce the fluid pressure in the annulus 30. In some implementations, the annular volume above the wellbore may include a riser that may be partially or completely filled with drilling fluid and/or with a different riser fluid. The density of the riser fluid, if used, may be less than that of the drilling fluid. It is also possible to drill such wellbores without a riser by using a rotating control head or rotating diverter coupled to the top of the wellbore (i.e., the wellhead) to seal against the drill string 16.

The drilling fluid pressure existing at the level of the water bottom may be controlled from the drilling rig 1 by selecting the inlet pressure to the subsea mudlift pump 20. In riser-type drilling systems as shown in FIG. 1, the height $H_1$ of the column of drilling fluid above the water bottom depends on the selected inlet pressure of the subsea mudlift pump 20, the density of the drilling fluid, the density of the riser fluid and the relative vertical elevation levels of each such fluid in the riser. The inlet pressure of the subsea mudlift pump 20 is equal to: $P=(H_1\gamma_b)+(H_2\gamma_s)$ in which $\gamma_b$ represents the density of the drilling fluid, $H_1$ represents the height of the drilling fluid column above the pump inlet point, $H_2$ represents the height of the column of riser fluid, and $.\gamma_s$ represent the density of the riser fluid.

$H_1$ and $H_2$ together make up the length of the riser section from the water bottom 8 and in some examples may extend upward to the deck 4 of the drilling rig 1. Filling the riser 12 at least in part with a riser fluid allows continuous flow quantity control of the fluid flowing into and out of the wellbore 15. Thus, it is relatively easy to detect a phenomenon, such as, for example, drilling fluid flowing out of the wellbore 15 into an exposed formation ("lost circulation"). It is furthermore possible to maintain a substantially constant drilling fluid pressure at the level of the water bottom when the drilling fluid density changes. Choosing a different inlet pressure to the subsea mudlift pump will cause the heights $H_1$ and $H_2$ to change according to the new selected subsea mudlift pump 20 inlet pressure. If so desired, the outlet 17 from the annulus 30 to the subsea mudlift pump 20 can be arranged at a level below the water bottom, by coupling a first pump pipe (not shown in FIG. 1) to the annulus at a level below the water bottom. In order to prevent the drilling fluid pressure from exceeding an acceptable level (e.g., in the case of a pipe "trip"), the riser 12 be provided with a dump valve. A dump valve of this type can be set to open at a particular pressure for outflow of drilling fluid to the body of water. Other examples may omit a dump valve.

As explained above, using a riser to exert part of the hydrostatic pressure on the wellbore annulus is optional, and in other implementations the riser may be omitted. Such implementations may use a rotating control head or other rotatable sealing device (not shown) to seal the annular space above the top of the wellbore 15 while enabling rotation and axial motion of the drill string 16.

In FIG. 1, reference number 1 denotes the drilling rig comprising a support structure 2, a deck 4 and a derrick 6. The support structure 2 is placed on the water bottom 8 and projects above the surface 10 of the sea. As explained above the deck may also be supported by a floating platform (not shown). A riser section 12 of a liner 14 extends from the water bottom 8 or a subsea wellhead (not shown) up to the deck 4, while the liner 14 runs further down into the wellbore 15. The riser section 12 is provided with required well head valves (not shown). The drill string 16 projects from the deck 4 and down through the liner 14. A first pump pipe 17 may be coupled to the riser section 12 near the water bottom 8 via a valve 18 and the opposite end portion of the pump pipe 17 is coupled to the intake of the subsea mudlift pump 20. In the present example the subsea mudlift pump may be placed near the water bottom 8. A second pump pipe 22 runs from the pump 20 up to a collection tank 24 for drilling fluid on the deck 4. A tank 26 for a riser fluid communicates with the riser section 12 via a connecting pipe 28 at the deck 4. The connecting pipe 28 may have a volume meter (not shown). Preferably, the density of the riser fluid is less than that of the drilling fluid, as explained above. The power supply for the subsea mudlift pump 20 is typically provided by an electrical cable (not shown) from the drilling rig 1, and the pressure at the inlet to the subsea mudlift pump 20 is selected from the drilling rig 1. The drilling fluid is pumped down through the drill string 16 in a manner that is known in the art, and returns to the deck 4 via an annulus 30 between the liner 14 and the drill string 16. When the subsea mudlift pump 20 is started, the drilling fluid is returned from the annulus 30 via the subsea mudlift pump 20 to the collection tank 24 on the deck 4.

While the example shown in FIG. 1 has the subsea mudlift pump 20 disposed near or on the water bottom 8, it should be understood that the subsea mudlift pump may be placed at any intermediate position along the return line 22. Thus, the depth of the subsea mudlift pump 20 in the body of water is not a limitation on the scope of the present invention.

The volume of fluid flowing into and out of the tank 26 is typically monitored, making it possible to determine, e.g., whether drilling fluid is being lost into an exposed formation (i.e., one not sealed by the liner 14), or whether gas or liquid is flowing from an exposed formation and into the wellbore 15 and fluid circulation system.

As explained in the Background section herein, most pumps that perform the function of the subsea mudlift pump 20 shown in FIG. 1 are either constant lift/constant head in the form of a centrifugal pump or are positive displacement pumps operated by hydraulic pressure. Example pumps will now be described with reference to FIGS. 2, 3 and 4 that are directly driven electrically, and can maintain very precise control over the rate at which fluid is discharged from the pump, making pressure control in the annulus more precise and more responsive to changes in subsea mudlift pump operation.

Figure 2:
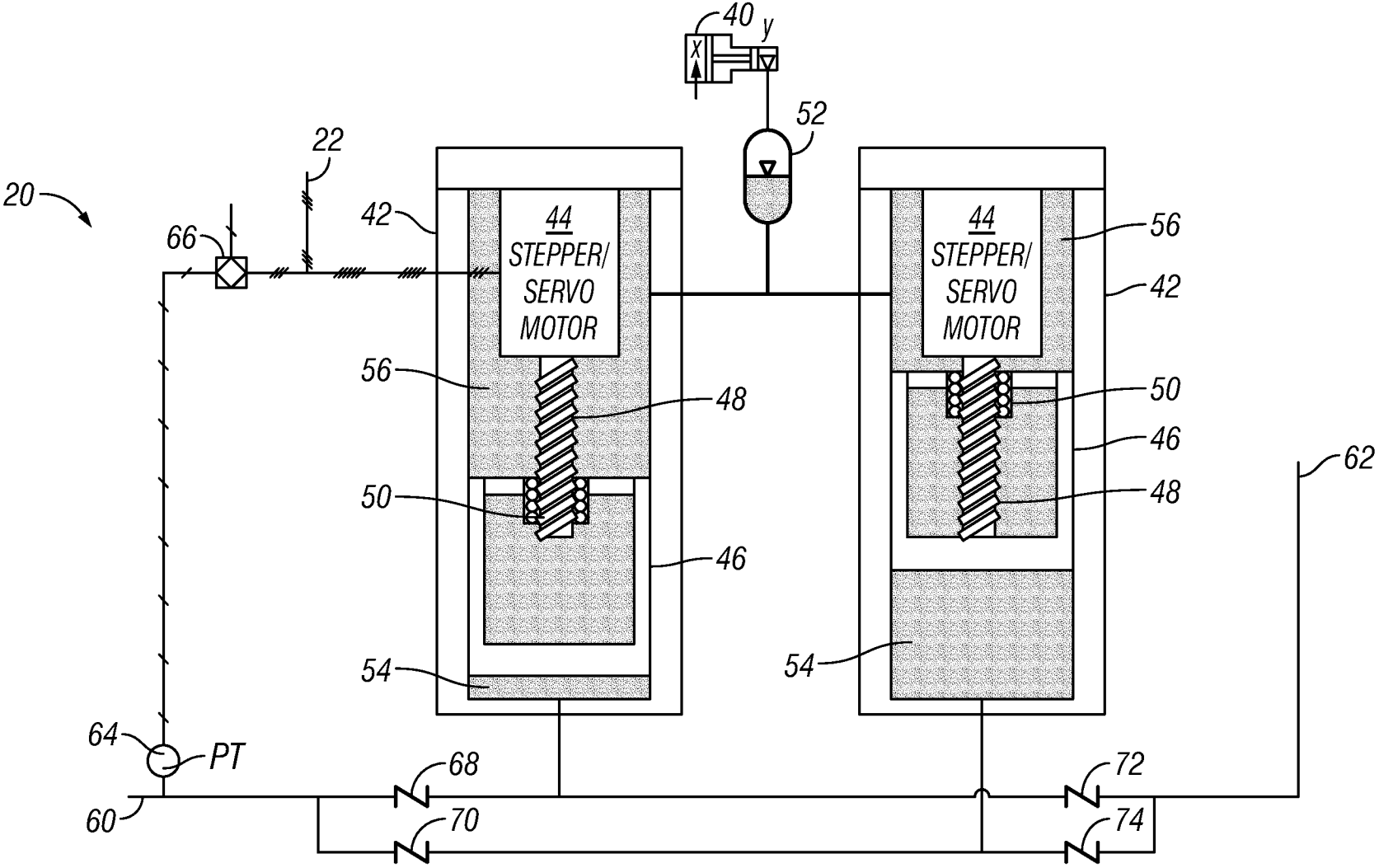
FIG. 2 shows one example embodiment of a direct drive subsea mudlift pump.

Referring to FIG. 2, which shows two "single action" subsea mudlift pumps 20 operating in tandem, each such subsea mudlift pump (hereinafter "pump" for convenience) 20 may be disposed in a pressure resistant, sealed housing 42. A plunger or piston 46 may be included to move fluid within the housing 42. One side of the piston 46 may be filled with hydraulic fluid or oil, such oil filled side being shown at 56. The oil filled side 56 may be in hydraulic communication with an oil reservoir 52. The reservoir 52 may be a variable volume accumulator of types well known in the art, wherein the accumulator is hydraulically divided into two separate chambers. One of the chambers may be filled with oil, and as stated may be in hydraulic communication with the oil filled side 56 of the piston 46 in each pump 20. The other side of the reservoir accumulator may be in hydraulic communication with the surrounding body of water. In the present example, the water pressure may be coupled to the water side of the reservoir 52 using an hydraulic intensifier 40 of types well known in the art. Thus, the hydraulic fluid or oil in the reservoir 52 may be maintained at a pressure above that of the surrounding water. Such pressure of the oil or hydraulic fluid may enable construction of the housing 42 such that it need not withstand extreme differential pressure between the interior thereof and the surrounding body of water. Such pressurization of the oil filled side 56 of the piston 46 will also serve to reduce the amount of force needed to be exerted by the piston 46 to move fluid from the fluid inlet 60 to the fluid outlet 62 during pump operation.

The piston 46 may be moved linearly within the housing 42 by a motor that is configured to generate precise linear motion in two opposed directions. The present example in FIG. 2 may be a stepper motor or servo motor 44 rotationally driving a jack screw 48 being connected at one end thereof to a ball nut 50 of types well known in the art. The position of the ball nut 48 is changed by rotation of the jack screw 48 disposed therein. The jack screw 48 may be rotated by precisely controlled rotation of the stepper or servo motor 44. Electrical power to operate the stepper or servo motor 44 may be provided by an electrical cable as explained with reference to FIG. 1, and such cable may be, although not necessarily, routed along with the fluid return line 22. A servo controller 66 may be in signal communication with a pressure transducer 64 disposed on the inlet side 60 of the pumps 20. As explained with reference to FIG. 1, a selected pressure at the pump inlet 60 may be transmitted from the drilling rig 1. Such pressure may be communicated to the servo controller 66, which may operate the servo motor 44 in such manner as to move the piston 46 so that the volume of a pumped fluid chamber 54 is changed in a precisely controlled manner with respect to time. A set of one way valves 68, 70, 72, 74 enable fluid to enter the chamber 54 from the pump inlet 60 when the volume of the pumped fluid chamber 54 is increased, and to discharge the fluid to a fluid outlet 62 when the volume of the pumped fluid chamber 54 is decreased. The two pumps 20 shown in FIG. 2 may be operated in any relative volume-phase relationship of the respective pumped fluid chambers 54 and piston 46 speeds such that the selected pressure is maintained at the pump inlet 60, and such that the fluid discharged at the pump outlet 62 may be relatively free of pressure and/or volume pulsations.

The example configuration shown in FIG. 2 includes two "single action" motor operated pumps. It should be clearly understood that other configurations of the subsea mudlift pump (20 in FIG. 1) may include more or fewer of the pumps configured as shown in FIG. 2. Thus, the number of pumps so configured as shown in FIG. 2 is not to be construed as a limitation on the scope of the invention. The number of pumps so configured may be related to factors such as the amount of drilling mud to be pumped, the pressure to be maintained at the pump inlet, the water depth, the drilling fluid density and other related factors.

The motor 44 may also be housed separately from the piston and cylinder. This exposes the back side of the piston 46 to the surrounding seawater and pressure.

Figure 3:
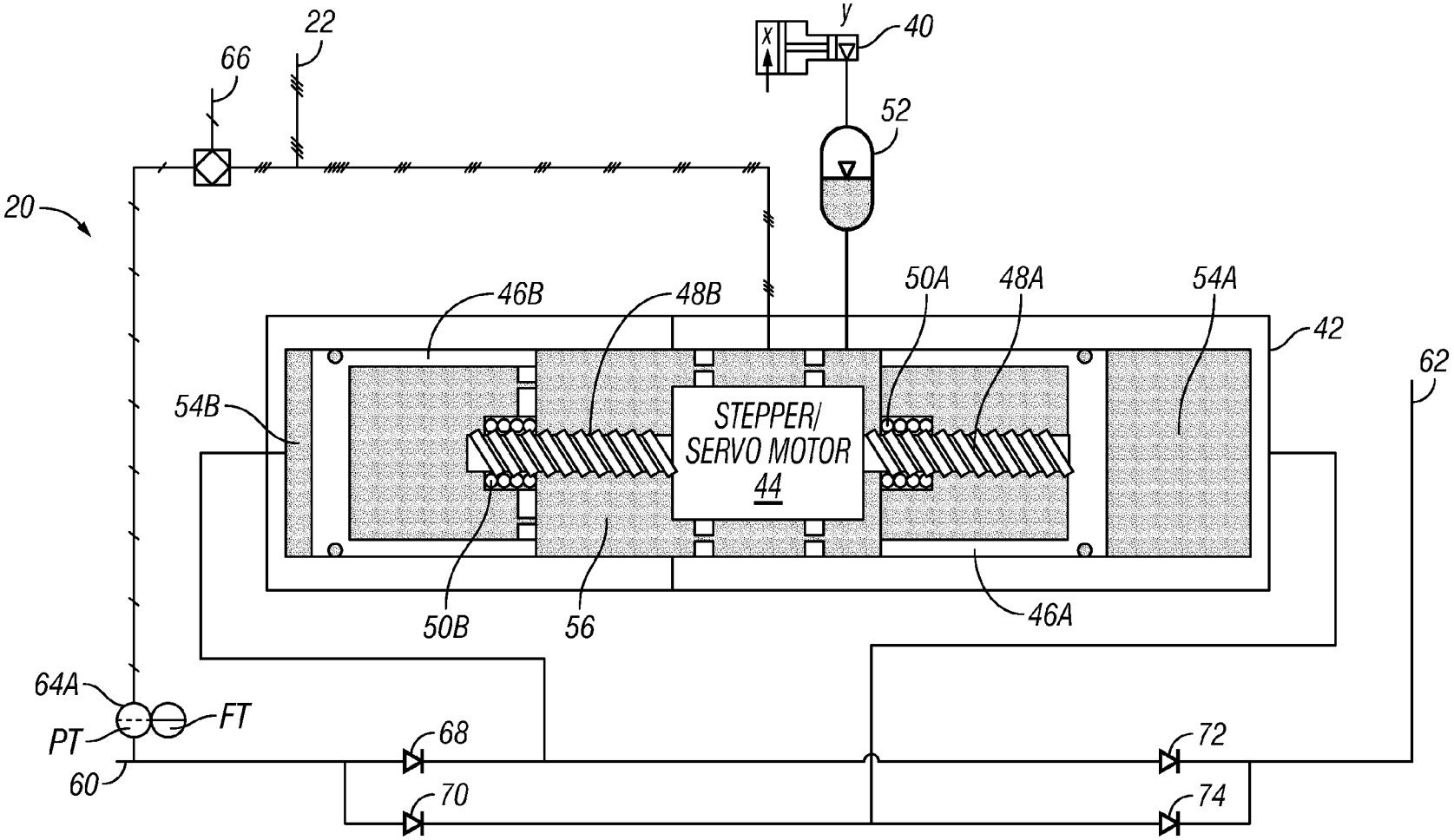
FIG. 3 shows another example embodiment of a direct drive subsea mudlift pump.

Another example configuration of the subsea mudlift pump 20 is shown in FIG. 3. Such configuration may be referred to as a "dual action" pump, because only one servo or stepper motor 44 and housing 42 is used, and within such housing 42 may be a piston 46A, 46B disposed on each side of the motor 44. The motor 44 may be similar to one of the motors shown in FIG. 2, but may include a jack screw 48A, 48B rotationally coupled to each end of the motor 44 shaft. Operation of the motor 44 may be performed by a controller 66 similar to the one explained with reference to FIG. 2. Each jack screw 48A, 48B may be rotationally coupled to a respective ball nut 50A, 50B. Each ball nut 50A, 50B may be coupled to a respective piston 46A, 46B. The space between the longitudinally outermost surfaces of the pistons 46A, 46B defines an oil filled chamber 56, just as in the configuration shown in FIG. 2. The oil filled chamber 56 may be filled with oil pressurized by a reservoir 52 and hydraulic intensifier 40 as explained with reference to FIG. 2.

The jack screws 48A, 48B may be arranged so that the pistons 46A, 46B move in the same direction, thus increasing the volume of one pumped fluid chamber 54B while decreasing the volume of the other pumped fluid chamber 54A as the motor 44 is operated. The jack screws 48A, 48B may in other examples be arranged so that the volume of each of the pumped fluid chambers 54A, 54B changes in the same way when the motor 44 is operated. A pressure transducer and flow meter combination 64A may be coupled to the fluid inlet 60 to provide suitable control signals for the motor controller 66. Power for the controller 66 and the motor 44 may be provided as explained with reference to FIGS. 1 and 2. A set of one way valves 68, 70, 72, 74 may be coupled to the pumped fluid chambers 54A 54B in a manner similar to the two separate pumped fluid chambers shown at 54 in FIG. 2 in order that fluid can move into each pumped fluid chamber 54A, 54B from the inlet 60 when the respective pumped fluid chamber increases in volume, and may discharge the fluid to the fluid outlet 62 when the respective pumped fluid chamber 54A, 54B decreases in volume. It will be appreciated by those skilled in the art that while only one of the present "dual action" subsea mudlift pumps is shown in FIG. 3, other configurations may include more than one such dual action pump operating in tandem. It will also be appreciated by those skilled in the art that whether the configuration used is the one shown in FIG. 2, or the one shown in FIG. 3, each pumped fluid chamber will require two valves so that the pumped fluid may move only in the direction from the fluid inlet 60 to the fluid outlet 62 as the pump(s) are operated. In still other examples, combinations of one or more single action pumps as in FIG. 2 and one or more dual action pumps as shown in FIG. 3 may be used.

Figure 4:
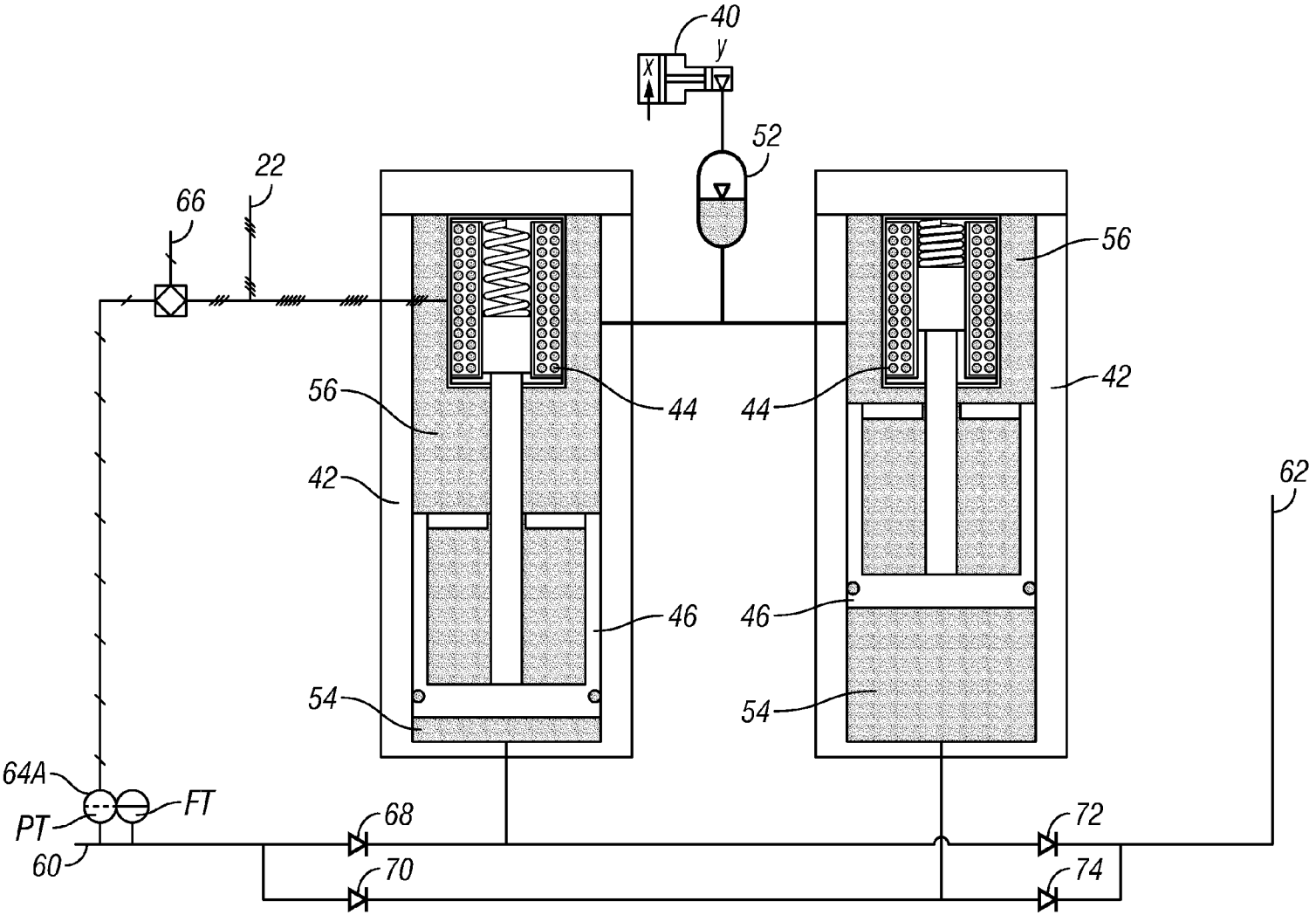
FIG. 4 shows another example pump using a linear actuator to drive the pump piston/plunger.

In another example, shown in FIG. 4, the piston or plunger 46 may be moved back and forth by a motor 44 such as a linear actuator or solenoid, so that rotation of the motor 44 is not required to operate the piston 46. The example shown in FIG. 4 may be single action as in FIG. 2 or dual action as in FIG. 3. Combinations of more than one pump as shown in FIG. 4 may be used in some implementations.

A marine drilling system including one or more subsea mudlift pumps according to the various aspects of the invention may provide more precise control over rate and volume of fluid pumped from out of a wellbore to the drilling rig above the water surface, and may be more reliable because of the solid material construction of the pump(s).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A subsea mudlift pump, comprising:

at least two pistons, each piston disposed in a respective separate pumped fluid chamber, the respective pumped fluid chambers being formed in one or more pressure sealed housings disposed in a body of water in which a wellbore is being drilled by a drilling rig disposed above the surface of the body of water;

at least two motors, each motor being coupled to one of the pistons and operable to cause reciprocating linear motion of a respective one of the pistons within the respective pumped fluid chamber;

a pressure sensor in pressure communication with a pump inlet for measuring pressure at the pump inlet; and a controller in signal communication with the pressure sensor, the controller being configured to operate the at least two motors to control the volume of each of the pumped fluid chamber and the respective speed of each of the pistons to provide a relative volume-phase relationship between the at least two separate pumped fluid chambers such that a pressure at the pump inlet has minimal variations and a discharge of the pump has minimal fluid pressure and/or flow rate variations.

2. The pump of claim 1 further comprising at least two valves in fluid communication with each of the pumped fluid chambers such that when each of the pumped fluid chambers increases in volume, wellbore drilling fluid enters such pumped fluid chamber from a wellbore annulus, and when each of the pumped fluid chambers decreases in volume, fluid is discharged therefrom into a return line extending from the pressure sealed housing to the drilling rig.

3. The pump of claim 1 wherein each motor is at least one of a stepper motor and a servo motor coupled to a jack screw.

4. The pump of claim 1 wherein the motor is a linear actuator.

5. The pump of claim 1 wherein a side of each piston facing the respective motor comprises an oil filled volume pressurized to at least a pressure of the body of water at a depth to which the pump is disposed.

* * * * *